United States Patent [19]

Akada et al.

[11] Patent Number: 4,910,188

[45] Date of Patent: Mar. 20, 1990

[54] DYE RECEIVING SHEET FOR PREPARATION OF A TRANSPARENCY

[75] Inventors: Masanori Akada, Ota; Noritaka Egashira, Ichikawa; Mikizo Mizuno, Takatsuki; Masaki Kutsukake, Chofu; Yoshikazu Ito, Setagaya; Tatsuya Kita, Shinjuku; Masahisa Yamaguchi, Nerima; Takao Suzuki, Kawagoe; Hitoshi Arita, Suginami; Kazuyoshi Sorimachi, Shinagawa; Tamami Iwata, Arakawa, all of Japan

[73] Assignee: Dai Nippon Insatsu Kabushiki Kaisha, Tokyo, Japan

[21] Appl. No.: 217,879

[22] PCT Filed: Jul. 30, 1987

[86] PCT No.: PCT/JP87/00563

§ 371 Date: Jun. 17, 1988

§ 102(e) Date: Jun. 17, 1988

[87] PCT Pub. No.: WO88/03093

PCT Pub. Date: May 5, 1988

[30] Foreign Application Priority Data

Oct. 23, 1986 [JP] Japan ..... 61-252646
Dec. 10, 1986 [JP] Japan ..... 61-294163
Mar. 20, 1987 [JP] Japan ..... 62-66880

[51] Int. Cl.[4] ..... B41M 5/035; B41M 5/26

[52] U.S. Cl. ..... 503/227; 8/471; 428/40; 428/195; 428/913; 428/914

[58] Field of Search ..... 8/471; 428/195, 212, 428/913, 914, 40; 503/227

[56] References Cited

U.S. PATENT DOCUMENTS 4,720,480 1/1988 Ito et al. ..... 503/227

*Primary Examiner*—Bruce H. Hess
*Attorney, Agent, or Firm*—Arnold, White & Durkee

[57] ABSTRACT

The dye receiving sheet for preparation of a transparency according to the present invention is a sheet to be used in combination with a heat transfer sheet having a dye layer formed thereon and includes (2) a transparent substrate, (3) a transparent receiving layer provided on the transparent substrate for receiving the dye migrating from the heat transfer sheet corresponding to the energy applied from a thermal head and (5) an optically detectable layer provided on at least a part of the heat transferable sheet. By the provision of the optically detectable layer (5), improvement of running performance, operability within a heat-sensitive device as well as image density and sensitivity during printing can be attained, and also a detection mark can be freely added, whereby operability of the dye receiving sheet can be further improved.

11 Claims, 6 Drawing Sheets

DYE RECEIVING SHEET FOR PREPARATION OF A TRANSPARENCY

TECHNICAL FIELD

This invention relates to dye receiving sheets (image receiving sheets) to be used for image formation according to the heat-sensitive recording method, and more particularly to a dye receiving sheet for preparation of a transparency which can be used in a projection device such as an overhead projector (OHP) or slide projector.

BACKGROUND ART

Heretofore, heat-sensitive recording means, which combine a heat transfer sheet and a dye receiving sheet and apply a desired printing on said dye receiving sheet with a thermal head have been known. Among this kind of dye receiving sheets, there exists a dye receiving sheet to be used primarily for a projection device, etc., comprising a transparent substrate and a transparent receiving layer provided on said substrate which receives the dye which has migrated from the heat transfer sheet, during heating.

However, the above dye receiving sheet is still inadequate in running performance within the heat-sensitive recording device, and also there are involved the drawbacks of low image density at the printed recording and also poor sensitivity even when heat transfer is carried out. Further, in the dye receiving sheet of the prior art, when a detection mark for control of running in the heat-sensitive recording is provided, this mark will remain even after image formation and therefore cause inconveniences when it is used for a projection device.

DISCLOSURE OF THE INVENTION

The present invention has been achieved in view of the above points, and it is intended to provide a dye receiving sheet for preparation of a transparency, which affords improvement of running performance within the heat-sensitive recording device, image density and sensitivity during printing, and also makes possible free addition of detection marks, etc.

The dye receiving sheet for preparation of a transparency according to the present invention is a sheet to be used in combination with a heat transfer sheet having a dye layer formed thereon and comprises (a) a transparent substrate, (b) a transparent receiving layer provided on the transparent substrate for receiving the dye migrating from the heat transfer sheet corresponding to the applied energy from a thermal head and (c) an optically detectable layer provided on at least a part of the sheet.

BEST MODES FOR CARRYING OUT THE INVENTION

Figure 1:
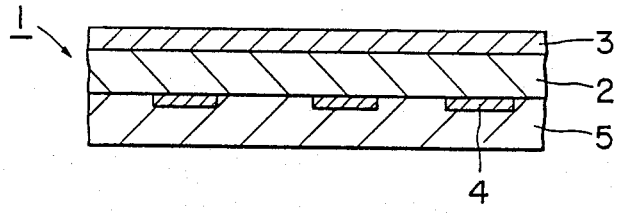
FIG. 1 through FIG. 3, FIG. 7 and FIG. 8 are each sectional views of the dye receiving sheet for preparation of a transparency according to the present invention.

FIG. 1 shows an example of the present invention, and the dye receiving sheet 1 for preparation of a transparency (e.g., a transmissive original) of the present invention is basically composed of a transparent substrate 2, a transparent receiving layer 3 provided on said substrate 2 and an optically detectable layer 5 provided freely peelably through a tackifier layer 4 on the surface of the above substrate opposite to the side where the transparent receiving layer 3 is provided.

In the case of this example, the optically detectable layer 5 is formed on the entire surface of the transparent substrate 2, and said optically detectable layer 5 also functions as a support sheet for supporting the transparent substrate 2 and the transparent receiving layer 3.

Also, in the present invention, the above optically detectable layer 5 may be provided partially within the sheet.

Figure 2:
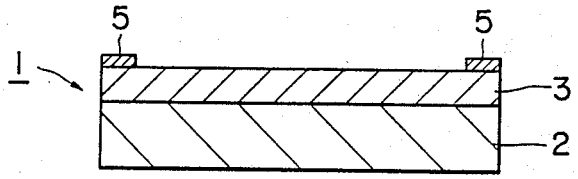
Figure 3:
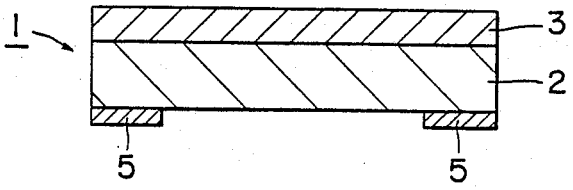
Figure 4A:
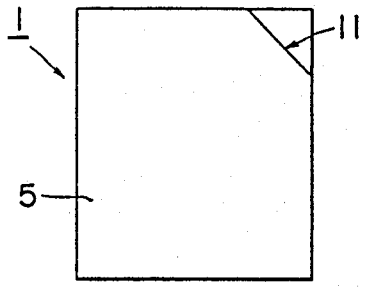
FIG. 4 is a plan view showing the pattern of the plane shape half cut.
Figure 4B:
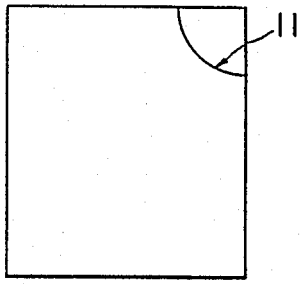
Figure 4C:
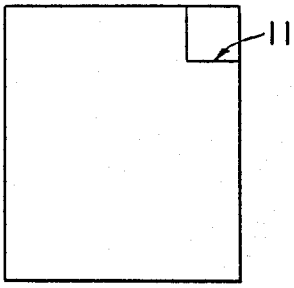
Figure 4D:
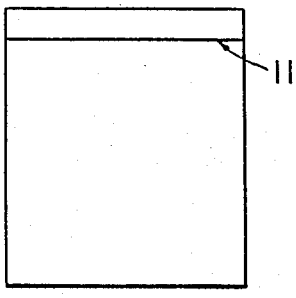
Figure 4E:
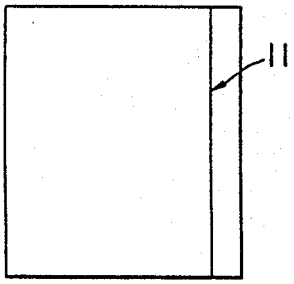
Figure 4F:
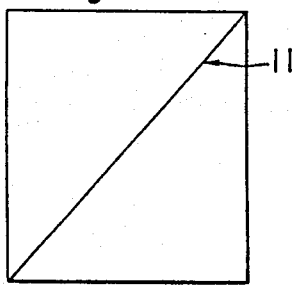
Figure 5A:
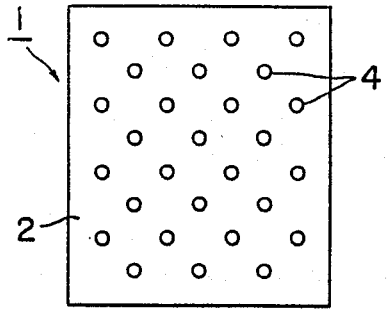
FIG. 5 is a plan view showing the pattern when a tackifier layer is provided.
Figure 5B:
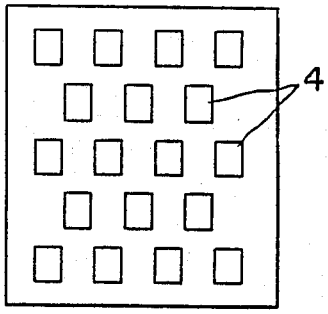
Figure 5C:
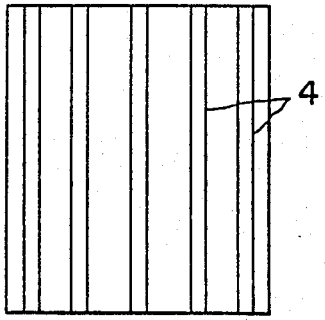
Figure 5D:
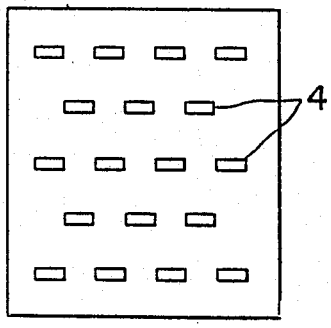
Figure 5E:
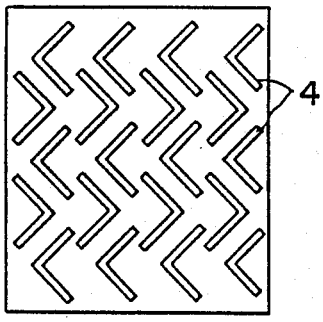
Figure 5F:
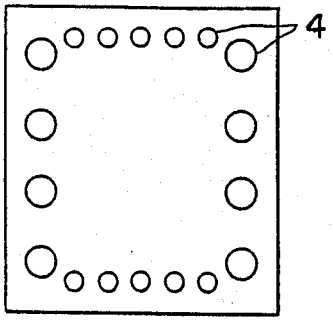
Figure 6A:
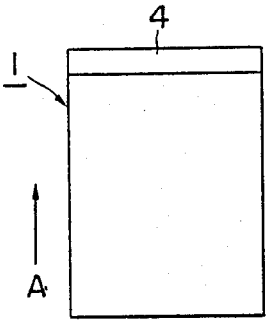
FIG. 6 is a plan view showing the embodiment when an optically detectable layer is partially provided on the sheet.
Figure 6B:
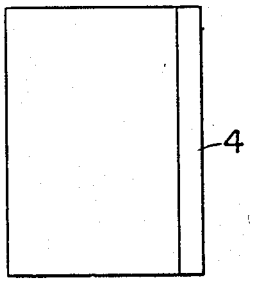
Figure 6C:
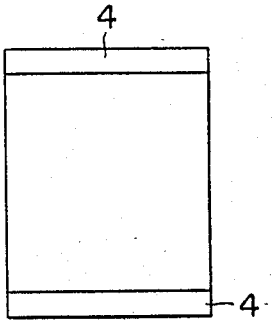
Figure 6D:
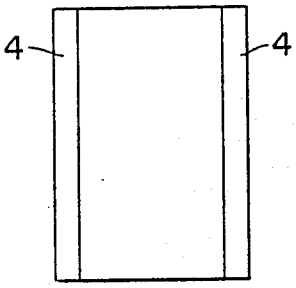
Figure 6E:
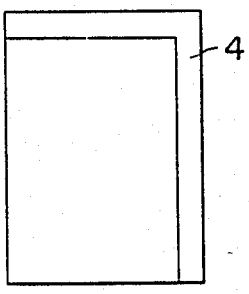
Figure 6F:
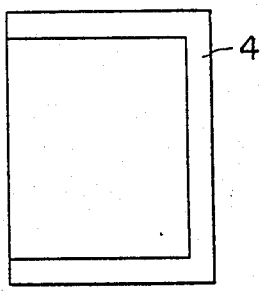
Figure 6G:
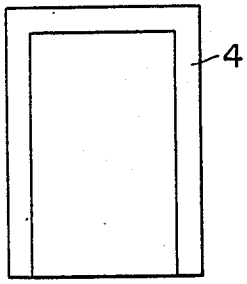
Figure 6H:
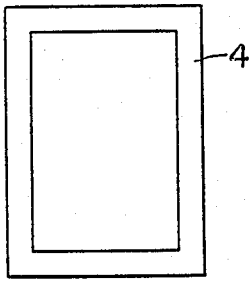

FIG. 2 and FIG. 3 are sectional views in the case where the optically detectable layer is partially provided within the sheet, and each of the cases in FIG. 2 and FIG. 3 shows an example when an optically detectable layer 5 as the margining worked portion was provided at the site corresponding to the peripheral of the light receiving layer 3 or the transparent substrate 2. Such an optically detectable layer as the margining worked portion will be described below.

In the following, the constitutions, materials, actions, etc. of the various layers as mentioned above are explained below.

Transparent substrate

As the transparent substrate, polyethylene terephthalate film is most preferably used, but rigid vinyl chloride, acrylic, vinylidene chloride, polyolefin films, etc. can also be used.

As the transparent substrate, those having thicknesses ranging from 25 to 100 μm can be used, but those having thicknesses ranging from 25 to 75 μm are preferred for making the image density high.

Transparent receiving layer

The transparent receiving layer comprises a light-transmissive resin layer capable of receiving the dye migrating from the heat transfer sheet by the applied energy from a thermal head. As such a transparent receiving layer, materials such as saturated polyester resins, polyacrylate resins, polyvinyl acetate resins, vinyl chloride-vinyl acetate copolymers, polystyrene resins, and polyamide resins are preferably used.

The above transparent receiving layer can also incorporate a mold release agent therein for imparting good mold release property. Examples of such a mold release agent available are silicone oils (e.g., combined use of epoxy-modified silicone and amino-modified silicone), and fluorine type or phosphoric acid ester type surfactants. In the case of a mold release agent with good compatibility with the above transparent receiving layer material, the mold release agent can be incorporated by mixing into said receiving layer, but a mold release agent with poor compatibility may be thinly applied on the surface of the receiving layer to form a mold release agent layer. Alternatively, the mold release agent may be mixed into the composition for forming the receiving layer and, after application, permitted to bleed out to form a mold release agent layer.

The thickness of the transparent receiving layer is, for example, preferably 0.1 to 10 μm when obtaining a dye receiving sheet with good transparency for OHP. Particularly, in the case of a receiving layer containing a mold release agent, the thickness of the receiving layer is 0.1 to 5 μm, more preferably 0.1 to 3 μm.

Optically Detectable Layer

In the present invention, the optically detectable layer formed in the sheet can be classified primarily into the two embodiments as described below.

First Embodiment:

That is, the first embodiment, as shown in FIG. 1, has an optically detectable layer 5 provided freely peelably on the whole surface of the transparent substrate 2, and said optically detectable layer 5 is peeled off after formation of an image on the transparent receiving layer by heat transfer onto the dye receiving sheet 1, or before projection by means of OHP, etc. Accordingly, the optically detectable layer 5 is laminated through a tacky layer which makes possible such peel-off. Therefore, in the first embodiment, the optically detectable layer functions as the support sheet for the heat transferable sheet.

The material for the optically detectable layer as such support sheet is required to be opaque and, when a transparent film is to be employed, an optically detectable layer such as light shielding layer may be coated, including specifically synthetic paper, cellulose fiber paper, synthetic resin sheet having fine uneven surface, etc. As the synthetic paper, those of the type in which polyolefins containing fillers are extruded and stretched, those of the type in which sheets of polyolefin, polystyrene, polyester are coated with mixtures comprising fillers and binders, etc. are used. As the cellulose fiber paper, pure paper, coated paper, art paper, cast coated paper, synthetic resins or worked paper impregnated, coated or internally added with synthetic resin or rubber, worked paper by extrusion lamination of polyethylene, etc. can be used. On the other hand, as the synthetic resin sheet having fine uneven surface on at least one surface (outer surface side), sheets extruded with fillers such as clay, calcium carbonate, titanium oxide, etc. contained therein, or laminated paper obtained by performing said extrusion onto pure paper, etc., or those having fine uneven pattern formed on the housing surface according to the sand blast method or the embossing method are used.

Also, the above support sheet 5 may have a porous or foamed structure as a whole. Such a porous or foamed structure can be obtained by:

(1) the method in which inorganic or organic particles are added to a thermoplastic resin, which is then stretched to thereby generate voids around the fine particles;

(2) the method in which an organic solvent solution of a synthetic resin is extruded through an orifice, then introduced into a coagulation bath to be coagulated through desolventization to generate voids by elimination of the solvent; or (3) the method in which a resin is extruded together with a foaming agent through an orifice to be foamed; etc., and a laminated product of these can be also used as the support sheet 4, but those with small cell size are particularly preferred when prepared according to the method of (3).

As materials for such a support sheet 5, those having high heat resistance such as polyesters (e.g., polyethylene terephthalate), aliphatic polyamides (e.g., 6-nylon), aromatic polyamides, polycarbonates, polyallylates, polyether sulfones, polyether ether ketones, polyether imides, and polyimides, are preferred. However, when no heating for post-working is effected from the support sheet 5 side, as in the case when it is used only for OHP, the material employed is not particularly required to have excellent heat resistance, and polyolefins such as polyethylene and polypropylene, polyvinyl chloride, polyvinylidene chloride, polyvinyl alcohol, acrylic resin, cellulose type resin, styrene type resin, ethylenevinyl acetate copolymer, ethylenevinyl alcohol copolymer, ionomer, etc. can be also used. The support sheet 5 should preferably have a thickness of about 25 to 125 μm. The density of the support sheet 5 (the density of the weight per 1 $m^2$ divided by the thickness) should preferably be of a value of 90% or less, particularly 80% or less and 60% or more relative to the density of the non-foamed product of the same material, which will produce the most remarkable color drift prevention effect.

The above support sheet (optically detectable layer) 5 can be applied with the half-cut treatment as shown in, for example, FIGS. 4(*a*) to (*f*) to cut either the support sheet 5 or the sheet practically used for projection, namely, the sheet comprising the transparent substrate 2 and the transparent receiving layer 3 so that the peeling work can be done easily (in the FIG. 11 shows the boundary line at the site to be cut; only in the case of the embodiment (f) in the Figure, the support sheet 5 is cut). Also, the support sheet 5 can have detection marks for heat-sensitive recording device (e.g., marks displaying grade, direction, front and back, size, etc.) formed by printing on said sheet 5.

As the tackifier for forming the tackifier layer 4, a tackifier with weak tackiness is preferable in order to make the support sheet 5 easily peelable from the transparent substrate surface, or otherwise conventional tackifiers can also be used. Examples of the tackifier with weak tackiness are those obtained by kneading inorganic particles, etc. into conventional tackifiers, tackifiers having weak properties of tacky force to the partner (specifically the substrate 2) on which the tackifier is to be formed, and those having mold release properties imparted by mixing a mold release agent with conventional tackifiers. Specific examples of the above tackifier are polyacrylates, acrylic copolymers, natural rubber, synthetic rubbers, petroleum resins, block copolymers such as SIS and SBR. If necessary, tackiness reinforcing agents, plasticizers, fillers, etc. can also be mixed with the above tackifier.

The above tackifier layer 4 can be provided on the entire surface of the transparent substrate 2 when it is formed by use of a tackifier with weak tackiness, while in the case of formation by use of a conventional tackifier, it is provided partially on the surface of the transparent substrate so as to make the support sheet readily peelable. When the tackifier layer is provided partially, it is provided in various patterns controlled in balance between the portion of the tackifier layer 4 and the portion where no said portion 4 is provided. Pattern formation examples of the tackifier layer 4 are shown in FIGS. 5 (*a*) to (*f*). The thickness of the tackifier layer is preferably 0.1 to 10 μm.

The support sheet as described above becomes the support for the dye receiving sheet, and it is also provided for the purpose of improving the paper passage characteristic in performing heat transfer printing. Accordingly, the support sheet is peeled off after formation of the image, or before being provided for projection by OHP, etc.

Also, since the thickness of the transparent substrate itself can be made thinner than that of the prior art by formation of such a support sheet, it will ultimately contribute to improvement of image density and sensitivity.

In the dye receiving sheet for preparation of transmissive original of the present invention as described above, which comprises a support sheet freely peelably provided through a tackifier layer on the surface of the transparent substrate on the side opposite to the side where the transparent receiving layer is provided, an appropriate stiffness or firmness of the transfer sheet itself can be maintained as compared with the dye receiving sheet comprising merely a transparent substrate and a transparent receiving layer, to be improved in running performance within a heat-sensitive recording device, and also accumulation of heat on the receiving layer side can be effected by insulation of the printing energy of the thermal head through the support sheet during heating printing. As a consequence, the dyability of the dye migrating from the heat transfer sheet can be improved, whereby there is the effect of the image density as well as the sensitivity being improved to give sharp images.

Also, according to the present invention, the transparent substrate itself can be made thinner than that of the prior art by provision of a support sheet, whereby rigidity of the substrate can be reduced to achieve improvement of image density as well as sensitivity. Further, when detection marks for a heat-sensitive recording device are provided on the support sheet, because said support sheet can be peeled off before projection, there is advantageously no risk of the detection marks remaining to cause troubles in projection.

Second Embodiment:

The second embodiment of the optically detectable layer is the case when an optically detectable layer is partially provided in the sheet. Specifically, as shown in FIG. 2 and FIG. 3, it is an embodiment in which an optically detectable layer is provided as the margining worked portion 5 around the sheet.

The margining worked portion 5 in such an embodiment comprises an optically detectable layer which is subjected to margining so as to be detected by a photoelectric tube detector, etc. By providing such a margining worked portion (optically detectable layer) 5, for example, when the dye receiving sheet 1 is fed to a heat-sensitive recording device having a photoelectric tube detecting mechanism, it becomes possible to detect (1) presence of feeding of the dye receiving sheet 1 into the device, (2) registration with the dye receiving sheet during printing, (3) grade of the dye receiving sheet and selection of actuation of the printing mechanism portion corresponding to its grade, (4) judgement of size, direction, front and back, etc. of the dye receiving sheet, etc.

The above margining worked portion 5 is formed at the site corresponding to the periphery of the transparent substrate 2, and, for example, it may be formed on the transparent receiving layer 3 corresponding to the periphery of the transparent substrate as in this example, between the transparent receiving layer 3 and the transparent substrate (not shown) or on the back of said substrate 2 corresponding to the periphery of the transparent substrate 2. More specifically, it can be formed at any desired one side, any desired two sides, any desired three sides and four sides on the back surface of the receiving layer 3 or the substrate 2 corresponding to the peripheral of the transparent substrate, and its formation pattern examples are shown in FIG. 6 (in the Figure, the arrowhead direction A indicates the paper feeding direction of the heat transfer sheet 1, and is applicable for all of the same FIGS. 6 (*a*) to (*h*)). Here, the formation position of the above worked portion 5 may be sufficient only at one side with respect to the paper feeding direction A of the dye receiving sheet (which is now supposed to be rectangular in shape) as shown in the same FIG. 6 (*a*), but for example, when the worked portion 5 is provided at the same time on the sides opposed to each other, the detection actuation of the photoelectric tube detector can be normally conducted even if the paper feeding direction of the heat transferable sheet 1 may be erroneously reversed. Also, the worked portion 5 may be in a continuous shape like a band as in this example, or alternatively in a partially fragmented shape.

The margining worked portion 5 in the present invention may be constituted of a constitution formed as completely secured, specifically with a printed layer by printing formation, or constituted by plastering of a member for margining. When constituted as in the former, an ink for margining containing an inorganic pigment such as silica powder, titanium oxide, zinc oxide, calcium carbonate, etc. is used and subjected to printing formation according to a coating method, etc. as already known in the art. When constituted as in the latter, by use of a member for margining such as papers, cloths, plastic tapes or metal foils (aluminum foil, etc.), the respective members are formed by adhesion by use of conventional tackifiers, etc.

Further the margining worked portion 5 has optical characteristics detectable to photoelectric tube detection mechanisms of various detection types, and therefore can be constituted to have any of light transmissive, light intransmissive, light reflective or light unreflective optical characteristics, and this is also the same in the case of the above support sheet.

The margining worked portion 5 of the above constitution has the effect of preventing the problem of adhesion between the sheets mutually between the dye receiving sheets for preparation of a transparency of the prior art at a rate of two or more sheets with static charges, etc. during conventional handling of the dye receiving sheet for preparation of a transparency or paper feeding to a heat-sensitive recording device. In order to have this effect of preventing adhesion remarkably exhibited, the margining worked portion 5 should preferably be provided over the entire region of the periphery as shown in FIG. 6(*h*).

Also in this embodiment, the above margining worked portion 5 can be also peeled off after image formation or before being provided for projection by OHP, etc. similarly as the support sheet 5 in the above first embodiment 1. Accordingly, the margining worked portion 5 can be provided on the transparent substrate 2 through the same tackifier layer or weak tackifier layer as in the case of the above support sheet, or alternatively provided by use of an ink of the type of which the film after drying can be peeled off.

The dye receiving sheet for preparation of a transparency of the present invention as described above comprises a margining worked portion at the site corresponding to the periphery of the transparent substrate, and therefore said margining worked portion can function as the detection mark. As a result, when it is fed to a heat-sensitive recording device equipped with an optical detection mechanism, there is the effect that heat-sensitive recording is possible while conventional detection is being performed.

Also, according to the present invention, there is the advantage that the margining worked portion in the dye receiving sheet can prevent adhesion mutually between the sheets through electrostatic charges, etc.

Further, according to the present invention, by formation of the above margining worked portion, the value in design of the dye receiving sheet for preparation of the transparency can be improved.

Transparent intermediate layer

In the present invention, between the transparent substrate and the transparent receiving layer, a specific transparent intermediate layer can be formed for improvement of printing characteristics and image characteristics. Such a transparent intermediate layer includes a number of embodiments.

Figure 7:
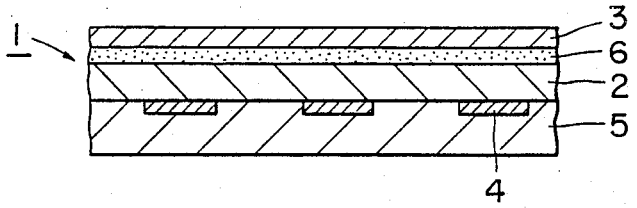

In the embodiment shown in FIG. 7, the transparent intermediate layer 6 comprises a specific resin layer. The material for such a transparent intermediate layer is preferably a resin having a glass transition point of 60° C. or lower, specifically a resin which can exhibit flexibility by heating with a thermal head such as polyester resins, polyurethane resins, but materials such as polyethylene resins, polyvinyl acetates, etc. are also usable.

The reason why the image quality can be improved by providing the transparent intermediate layer as described above is not necessarily clear, but it may be speculated that the printing portion is deformed by the heat from the thermal head during printing, and the head adheres or fits thereto under the optimum state, whereby good image density can be exhibited to improve image quality along with transparentness.

In the case when adhesion between the transparent substrate and the transparent intermediate is insufficient, a primer layer can also be interposed between these layers for improvement of adhesion. Such a transparent intermediate layer should have preferably a thickness of 3 to 10 μm.

The transparent intermediate layer as described above is very effective in improving transparentness, image density and sensitivity, and is preferably used particularly when making the layer thickness of the above transparent receiving layer relatively thinner.

Also, the transparent intermediate layer 6 may also comprise a transparent resin layer having specific physical properties. Such a transparent resin layer, as the result of lowering the rigidity of the transparent substrate 2, can perform paper delivery of the heat transferable sheet in a printing device more smoothly, and can further enhance the printing density through the cushioning property of the transparent intermediate layer (transparent resin layer). For this reason, the resin constituting the transparent resin layer 6 should be preferably one having a 100% modulus value as defined in JIS-K-6301 of 150 kg/cm$^2$ or lower, including, for example, thermoplastic resins such as polyesters, vinyl chloride-vinyl acetate copolymers, acrylic resins, polyvinyl acetates, ethylene-vinyl acetate copolymers, alkyl titanate resins, vinyl acetate-acrylic copolymers, polyethyleneimines, polyvinyl chlorides, polybutadienes, polyethylenes, ethylene-acrylic copolymers, polypropylenes, ionomer resins, polystyrenes, and polyurethane elastomers, polyurethane, and epoxy type resins. Also, in addition to the above resins, UV-ray curable resins, electron beam curable resins can be also used. The transparent resin layer 6 can be formed with a tacky material, adhesive comprising the above resin. As the method for formation of the transparent resin layer 6, other than a conventional solution coating method, there may be employed extrusion coating, hot melt coating, or it may be also formed by other coating methods. Such a transparent resin layer 6 preferably has a thickness of 1 to 200 μm.

Further, in the present invention, the transparent intermediate layer may be also constituted of a soft layer having cushioning property with a 100% modulus as defined in JIS-K-6301 of 250 kg/cm$^2$ or lower. Such a cushioning layer (transparent intermediate layer) 6 is provided so that the receiving layer can be changed to the optimum state corresponding to the tip end of the head when the printing portion is urged against a thermal head during printing, and better cushioning property can be imparted as its thickness is thicker, leading to improvement of printing density. Specific examples of said cushioning layer are layers comprising polyurethane resin, polyester resin, acrylic resin, ethylene-vinyl acetate copolymer resin, vinyl acetate-acrylic copolymer resin, polyvinyl chloride resin, polyethylene resin, polypropylene resin, polystyrene resin, polyurethane elastomer, epoxy resin, vinyl chloride-vinyl acetate copolymer resin, polyvinyl acetate resin, alkyltitanate, polyethyleneimine, polybutadiene, ethylene-acryl copolymer resin, and ionomer. Also, while the thickness of the cushioning layer is preferably as thick as possible to impart good cushioning property as mentioned above, if it is too thick, the whole thickness of the dye receiving sheet becomes too thick. Accordingly, it is preferably selected to be within the range of from 1 to 200 μm, as necessary, but a thickness of about 3 to 70 μm, more preferably 5 to 40 μm, is suitable for obtaining better cushioning property.

As the method for formation of the cushioning layer, other than conventional solution coating method, extrusion coating, hot melt coating, etc. can also be used. Also, after impregnation of an appropriate support with an ink composition for formation of the cushioning layer, both surfaces can be laminated with the substrate and the sheet-shaped product as described below to form a cushioning layer.

Also, fine air bubbles can be also formed in the cushioning layer for further enhancing cushioning properties. For formation of air bubbles, (1) the method in which a W/O type emulsion is used as the ink composition for formation of cushioning layer, (2) the method in which a foaming agent is added, (3) the method in which an unwoven fabric is impregnated with ink, (4) the method in which air bubbles are entrained by carrying out stirring during coating of ink, etc. can be employed.

Also, in the above embodiment, it is also possible to use a constitution in which a sheet-shaped product (not shown) is interposed between the cushioning layer 6 and the receiving layer 3 for separation of both the layers. By interposition of such a sheet shaped product, migration of the resin from the cushioning layer 6 to the receiving layer 3 can be prevented, and also migration of the ink transferred onto the receiving layer 3 during printing to the cushioning layer 6 can be prevented.

The material of such sheet-shaped product can be selected from polyethylene terephthalate, stretched polypropylene, nonstretched polypropylene, ethylene-vinyl acetate copolymer, ionomer, cellulose acetate, polycarbonate, rigid or semi-rigid vinyl chloride, etc., and also papers such as condenser paper, etc. can be used. The sheet shaped product is of a thickness preferably of about 2 to 60 μm.

Lubricating layer

Figure 8:
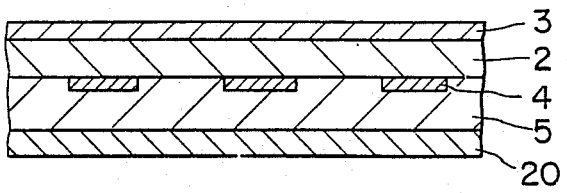

In the present invention, as shown in FIG. 8, a lubricating layer 20 can be formed on the back side of the support sheet 5.

The lubricating layer 20 is provided for making it easier to take out the dye receiving sheet for preparation of the transmissive original, one by one. The lubricating layer can be formed of various materials, but representative ones are materials which are readily slippable with the contacted partner when superposed on one another, namely, those with small coefficients of static friction.

Suitable materials with such small static frictional coefficients are synthetic resins as exemplified by vinyl type resins such as methacrylate resins such as methyl methacrylate or its corresponding acrylate resin, and vinyl chloride/vinyl acetate copolymer resins.

While the reason for this is not necessarily clear, when a lubricating layer 20 is provided, the sheet becomes not easily chargeable probably because of small friction between the sheets, whereby the extent of antistatic treatment can be alleviated. For example, by application of the antistatic treatment on only the back of the heat transferable sheet for preparation of a transparency, it becomes advantageously possible to prevent charging of the sheet as a whole.

The lubricating layer 20 may be formed only of the resin as mentioned above, but (1) waxes or (2) inorganic fillers may be also added therein.

Examples of the above waxes (1) are synthetic waxes, specifically polyethylene wax, Fischer-Tropsch wax, montan wax derivatives, paraffin wax derivatives, microcrystalline wax derivatives, hardened castor oil and derivatives thereof, hydroxystearic acid, stearic acid amide, phthalic anhydride amide, and chlorinated hydrocarbons, natural waxes, specifically, canderilla wax, carunauba wax, rice wax, wood wax, hohoba oil, beeswax, lanolin, whale wax, montan wax, microcrystalline wax, petrolatum, etc., phosphoric acid esters, and silicone.

As the above inorganic fillers (2), silica, talc, clay, calcium carbonate, barium sulfate, activated clay, zeolite, etc. can be used.

The amount of the friction reducer added into the lubricating layer can be 0.5 to 15 parts by weight based on 100 parts by weight of the resin, more preferably 1 to 15 parts by weight. The particle size of the friction reducer, particularly the particle size of inorganic fillers is 1 μm to 30 μm, more preferably 4 μm to 10 μm. When a friction reducer is desired, it may be added into the paint for formation of the lubrication layer or it may be applied on the lubricating layer after formation of the lubricating layer.

Antistatic treatment

The dye receiving sheet of the present invention may be subjected to antistatic treatment.

Application of antistatic, treatment on at least either the front or back of the dye receiving sheet will be sufficient as a general rule for preparation of the transparency.

Antistatic treatment is performed for permitting charges generated on the heat transferable sheet by charging during handling of the dye receiving sheet to escape easily, and it may be formed by use of a material having electroconductivity, but generally a material called antistatic agent is used.

As the antistatic agent, cationic surfactants (e.g., quaternary ammonium salts and polyamine derivatives), anionic surfactants (e.g., alkylphosphates) or nonionic surfactants (e.g., fatty acid esters) can be used, and further polysiloxane type antistatic agents can be also used. In connection with the above antistatic agents, amphoteric surfactants or cationic water soluble acrylic resins can be formed singly into paints to form an electroconductive layer by formation of a coated film with a coated amount on drying of about 0.1 to 2 g/m$^2$, and desirably such a water-soluble acrylic resin will not dissolve the dyes by influencing the colorant layer (contacted with the electroconductive layer by piling or winding) of the heat transfer layer even under high humidity conditions.

The antistatic agent as described above is used in the form of an organic solvent solution such as an alcoholic solution, a toluene solution, or an aqueous solution, and it may be prepared by dissolving or dispersing in an organic solvent solution of the resin to be used as the binder.

The resin to be used as the binder is preferably selected from (a) thermosetting resins such as thermosetting polyacrylate resins, polyurethane resins, or (b) thermoplastic resins such as polyvinyl chloride resins, polyvinyl butyral resins, and polyester resins.

The prepared electroconductive paint is generally coated by an ordinary method, for example, by a blade coater, a gravure coater, or a spray coater.

The thickness of the electroconductive layer is 0.1 to 3 μm, sometimes 0.1 to 5 μm depending on the conditions, and the ratio of the binder to the electroconductive substance is determined so that the surface resistivity of the electroconductive layer after coating and drying (in some cases after curing) will be $1\times1010$ ohm.cm. An amphoteric or cationic water soluble acrylic resin can be formed into an alcoholic solution and can also be used as the electroconductive substance formed into a paint added in an amount of 5 to 30 wt. % as the solid component relative to the binder.

As the method for applying the antistatic agent treatment, there are:

(1) the method in which an organic solvent solution of an antistatic agent is applied directly on the receiving layer;

(2) the method in which a mixed solution of a peeling agent and an antistatic agent is applied on the receiving layer; and (3) the method in which an antistatic agent is applied on the surface opposite to the receiving layer of the substrate sheet and dried, which step is then followed by wind-up, and a part of the coated antistatic agent is transferred onto the receiving layer in contact therewith.

The heat transfer sheet to be used in combination with the dye receiving sheet of the present invention is not required to be applied with the antistatic treatment to cancel most of the troubles caused by charging, provided that the heat transferable sheet is applied with antistatic treatment. However, for cancelling further the troubles caused by charging during recording, the use of a heat transfer sheet applied with antistatic treatment by provision of an antistatic agent on the back side (on the side opposite to that where a colorant layer is provided) is recommended.

Use method

Figure 9:
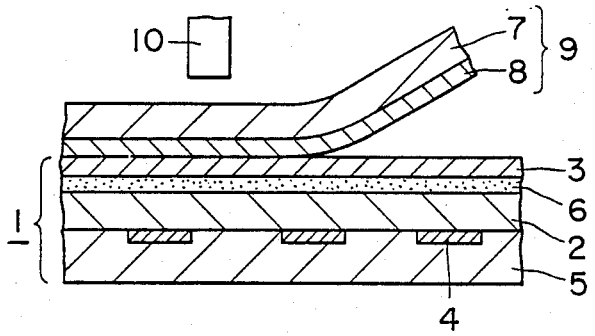
FIG. 9 is a sectional view showing how heat-sensitive transfer, is effected by use of the dye receiving sheet of the present invention.

In performing transfer practically by the use of the heat transferable sheet 1 of the present invention, as shown in FIG. 9, heating is effected with a thermal head 10 with a heat transfer sheet 9 having a heat transfer sheet 8 formed on the substrate 7, and the dye in the heat transfer layer 8 migrates onto the transparent receiving layer 3 of the dye receiving sheet 1 to form an image, thus effecting transfer.

The present invention is described below by way of specific Examples.

EXAMPLE A-1

On a polyethylene terephthalate film with a thickness of 50 μm, a solution of a saturated polyester resin (Vylon 600, produced by Toyobo, Japan) in a solvent mixture of toluene/methyl ethyl ketone=1/1 was coated by the reverse roll coating method, followed by drying to form an intermediate layer (coated amount after drying 7 g/m$^2$). On said intermediate layer was coated an ink composition for forming a receiving layer comprising the composition shown below by use of diagonal line plate gravure rolls for solid printing according to the reverse roll coating method, followed by drying to form a receiving layer (coated amount after drying 3 g/m$^2$).

Ink composition for forming receiving layer:

| | |
|---|---|
| Polyester resin (Vylon 200, manufactured by Toyobo, Japan) | 70 parts by wt. |
| Polyester resin (Vylon 290, manufactured by Toyobo, Japan) | 30 parts by wt. |
| Amino-modified silicone (KF-393, produced by Shinetsu Kagaku, Japan) | 5 parts by wt. |
| Epoxy-modified silicone (X-22-343, produced by Shinetsu Kagaku, Japan | 5 parts by wt. |
| Methyl ethyl ketone/Toluene (weight ratio 1/1) | 700 parts by wt. |

On the dye receiving sheet thus prepared on the side opposite to the receiving layer was integrated a support of synthetic paper Yupo EPG 110 μm (produced by Oji Yuka Goseishi, Japan) having Vylon 600 as the adhesive coated to a coated amount after drying of 10 g/m$^2$, followed by drying in air.

On the other hand, with the use of a polyethylene terephthalate film with a thickness of 6 μm having a heat-resistant layer comprising a thermosetting acrylic resin provided on one surface as the substrate, the composition shown below was coated by use of a wire bar and dried to provide a heat transfer layer of 1 g/m$^2$ (solid component), thus forming a heat transfer sheet.

Composition for heat transfer layer:

| | |
|---|---|
| Disperse dye (Kayaset Blue 714, produced by Nippon Kayaku, Japan) | 4 parts by wt. |
| Polyvinyl butyral resin (Ethlec BX-1, produced by Sekisui Kagaku, Japan) | 4 parts by wt. |
| Methyl ethyl ketone/toluene (weight ratio 1:1) | 91 parts by wt. |

The heat transfer layer of the above heat transfer sheet and the receiving layer of the dye receiving sheet were superposed so as to contact each other, and heated by a thermal head from the heat-resistant layer side of the heat transfer sheet, to transfer the dye to the receiving layer of the dye receiving sheet, and the support was peeled off together with the adhesive from the dye receiving sheet having an image formed thereon. Projection by means of an overhead projector gave a sharp projected image without coloration at the non-image portion.

EXAMPLE A-2

On a polyethylene terephthalate film with a thickness of 25 μm, an ink composition for forming a receiving layer with the composition shown below was coated by a wire bar and dried to provide a receiving layer with a coated amount after drying of 6 g/m$^2$.

| | |
|---|---|
| Polyester resin (Vylon 200, produced by Toyobo, Japan) | 70 parts by wt. |
| Polyester resin (Vylon 290, produced by Toyobo, Japan) | 30 parts by wt. |
| Methyl ethyl ketone/toluene (weight ratio 1:1) | 700 parts by wt. |

On the above layer was solid printed by gravure printing a toluene solution having a catalyst added to Silicone KS-778 (produced by Shinetsu Kagaku) for mold release for imparting mold release properties, followed by drying in hot air, to an amount attached after drying of about 0.3 g/m$^2$, thus providing a heat transferable sheet.

On the other hand, on the back surface of a pure paper (82 g/m$^2$), a solution of an amphoteric type antistatic agent (ST-1000, produced by Mitsubishi Yuka Fine, Japan) in isopropyl alcohol/water (weight ratio 4/6) was coated by solid plate of gravure printing to a coated amount after drying of 0.2 g/m$^2$, followed by drying in hot air. The pure paper was cut into A4 size, and the four sides around the A4 size paper were coated with a polyester resin (Vylon 630) as the adhesive and dried. The support sheet thus obtained was caused to adhere to the heat transferable sheet on the side opposite to the receiving layer.

By the use of the heat transferable sheet integrated with the support, projection was effected by means of an overhead projector similarly as in Example A-1 to confirm that it was a good sheet for OHP.

EXAMPLE A-3

By the use of a support subjected to extrusion coating of a pure paper (52 g/m$^2$) with a mixture of polypropylene and titanium oxide, an isopropyl solution of an antistatic agent Statiside (a cationic surfactant, produced by Analytical Chemical Laboratory of Scoky) was applied on the propylene side (coated amount after drying 0.1 g/m$^2$), and a polyester resin (Vylon 630) as the adhesive on the pure paper on the opposite surface (coated amount after drying 8 g/m$^2$), followed by drying, and the same dye receiving sheet was caused to adhere thereto. Projection by means of an overhead projector practiced similarly as in Example A-1 gave good results.

EXAMPLE A-4

On one surface of the same synthetic paper as that used in Example A-1, gravure printing was effected by use of a grayish black ink, and at the 4 places as the total near both the ends of both the left and right longer sides of the synthetic paper of A6 size, trapezoidal marks were provided to prepare a support.

As the dye receiving sheet, that in Example A-1 was prepared, formed into A6 size, and then superposed so that the surface to be printed of the above support would face the side of the film where there is no receiving layer, and to one superposed shorter side was caused to adhere a double-side adhesive tape.

The composite sheet was used with the composite shorter side ahead thereof to be subjected to reading of the marks of the support by means of a reflective type photosensor placed at the entrance of a heat-sensitive transfer printer for confirmation of the desired sheet, and then the sheet was permitted to run to form an image by transfer by use of the heat transfer sheet in the same manner as in Example A-1.

EXAMPLE B

By the use of a polyethylene terephthalate (T-PET, produced by Panack Kogyo, Japan) with a thickness of 100 μm as the transparent substrate, a composition for forming a receiving layer having the composition shown below was coated on its surface by wire bar coating to a thickness on drying of 4 μm, dried tentatively by a dryer and then dried in an oven at 100° C. for 30 minutes to form a transparent receiving layer.

Composition for forming receiving layer:

| | |
|---|---|
| Polyester resin (Vylon 200, produced by Toyobo, Japan | 15 parts by wt. |
| Toluene | 30 parts by wt. |
| Methyl ethyl ketone | 30 parts by wt. |
| Amino-modified silicone (KF-293, produced by Shinetsu Kagaku, Japan) | 5 parts by wt. |
| Epoxy-modified silicone (X-22-343, produced by Shinetsu Kagaku, Japan) | 5 parts by wt. |

On the above polyethylene terephthalate a weak tackifier (Esdaine AE-206, produced by Sekisuiesdaine, Japan) was applied in patterns on the receiving layer surface and the opposite surface to form partial tackifier layers, and pure papers were caused to adhere thereon to form the heat transferable sheet of the present invention.

The above dye receiving sheet was superposed on a heat transfer sheet, and heated by a thermal head from the substrate side of the heat transfer sheet (output 1W.dot, pulse width 0.3–0.45 m/sec., dot density 3 dots/mm), to form an image by transfer of the disperse dye in the heat transfer layer of the heat transfer sheet to the receiving layer of the dye receiving sheet. The dye receiving sheet from which the pure papers were peeled off together with the weak tackifier was then projected by means of an overhead projector, whereby a sharp projected image could be obtained.

EXAMPLE C-1

By the use of a polyethylene terephthalate film with a thickness of 100 μm (Lumilar 100, produced by Toray) as the transparent substrate, an ink composition for forming a receiving layer having the composition shown below was applied on said film to an amount coated after drying of 4.0 g/m$^2$, followed by drying, to form a transparent receiving layer.

Composition for forming receiving layer:

| | |
|---|---|
| Polyester resin (Vylon 200, produced by Toyobo, Japan) | 1 part by wt. |
| Amino-modified silicone (KF-393, produced by Shinetsu Kagaku Kogyo, Japan) | 0.03 part by wt. |
| Epoxy-modified silicone (X-22-343, produced by Shinetsu Kagaku Kogyo, Japan) | 0.03 part by wt. |
| Methyl ethyl ketone/toluene/cyclohexanone (weight ratio 4:4:2) | 9.0 parts by wt. |

An ink composition for margining having the composition shown below was then applied along one of the formation pattern examples shown in FIG. 6 to a coated thickness on drying of 10 μm to form a margining worked portion, thus obtaining a heat transferable sheet. Ink composition for margining:

| | |
|---|---|
| Polyester resin (Vylon 200, produced by Toyobo, Japan) | 1 part by wt. |
| Titanium oxide | 0.1 part by wt. |
| Methyl ethyl ketone | 4 parts by wt. |
| Toluene | 4.9 parts by wt. |

On the other hand, an ink composition for formation of a heat transfer layer having the composition shown below was applied on a polyethylene terephthalate film applied on the back surface with a heat-resistant treatment to a coated amount on drying of 1.0 g/m$^2$, followed by drying to obtain a heat transfer sheet.

Ink composition for forming heat transfer layer:

| | |
|---|---|
| Disperse dye (KST-B-136, produced by Nippon Kayaku, Japan) | 0.4 part by wt. |
| Ethylhydroxyethyl cellulose (produced by Hercules) | 0.6 part by wt. |
| Methyl ethyl ketone/toluene (weight ratio 1:1) | 9.0 parts by wt. |

The heat transfer layer of the heat transfer sheet and the transparent receiving layer of the above dye receiving sheet were superposed under the state of facing each other, and printing was effected by heating from the heat transfer sheet side with a thermal head to form an image.

The above dye receiving sheet was found to perform normal detection by means of a detection mechanism during heat-sensitive recording, and also there was substantially no generation of adhesion between the sheets before and after the heat-sensitive recording.

EXAMPLE C-2

By the use of the same transparent substrate and transparent receiving layer as in Example C-1, a pure paper with a thickness of 50 μm and a width of 5 mm was stuck onto the above receiving layer along either one example of the formation pattern examples shown in FIG. 6 with a tackifier (Prit, produced by Kokuyo, Japan) to form a margining worked portion.

By the use of the same heat transfer sheet as in Example C-1, transfer was effected by means of a heat-sensitive recording, device to form an image.

The above dye receiving sheet was found to be normally detected by the detection device during heat-sensitive recording, and also there was substantially no generation of adhesion between the sheets before and after heat-sensitive recording.

COMPARATIVE EXAMPLE C

Without formation of the margining worked portion, a dye receiving sheet comprising otherwise the same transparent substrate and transparent receiving layer as in Example C-1 was formed.

The above dye receiving sheet gave rise to remarkable generation of adhesion between sheets before and after heat-sensitive recording. Also, the above sheet could not feed papers to the heat-sensitive recording device equipped with a detection mechanism, and double sheet feed, etc. occurred even when feeding papers to other heat-sensitive recording devices, thus exhibiting high adhesiveness.

EXAMPLE D-1

As a transparent substrate sheet, a colorless transparent polyethylene terephthalate film (T-PET, produced by Toray, Japan) with a thickness of 100 μm was prepared, and a transparent receiving layer was formed by wire bar coating by the use of a composition for formation of a receiving layer having the composition shown below to a thickness on drying of 4 μm, tentatively dried and then dried in an oven of 100° C. for 30 minutes.

Composition for forming receiving layer:

| | |
|---|---|
| Polyester resin (Vylon 200, produced by Toyobo, Japan) | 15 parts by wt. |
| Toluene | 30 parts by wt. |
| Methyl ethyl ketone | 30 parts by wt. |
| Amino-modified silicone (KF-393, produced by Shinetsu Silicone, Japan) | 5 parts by wt. |
| Epoxy-modified silicone (X-22-343, produced by Shinetsu Silicone, Japan) | 5 parts by wt. |

Separately from the above, a white polyethylene terephthalate sheet with a thickness of 50 μm (E-20, produced by Toray, Japan) was prepared, and on its surface was provided a lubricating layer by the use of a composition for formation of a lubricating layer having the composition shown below according to wire bar coating to a coated amount on drying of 1 g/m$^2$.

Composition for forming lubricating layer:

| | |
|---|---|
| Acrylic resin (BR-85, produced by Mitsubishi Rayon, Japan) | 15 parts by wt. |
| Microsilica (Siloid 162, particle size 10 μm, produced by Fuji Davidson Kagaku K.K., Japan) | 0.5 part by wt. |
| Methyl ethyl ketone | 74.5 parts by wt. |

On the surface of the white polyethylene terephthalate film on the side opposite to the side where the lubricating layer was provided, a weak tackifier (Sekisui Esdaine AE-246, produced by Sekisui Kagaku, Japan) was coated by wire bar coating to a coated amount of on drying of 3 g/m$^2$.

Both sheets were superposed so that the back surface of the polyethylene terephthalate film having a transparent receiving layer provided on the front surface obtained above and the surface of the white polyethylene terephthalate film opposite to the side provided with the lubricating layer were superposed on one another to obtain a dye receiving sheet for preparation of a transmissive, original of the present invention.

The dye receiving sheet for preparation of the transmissive original obtained was cut into sizes of 10.0 cm×13.0 cm and 100 sheets were superposed on one another so that all the receiving layers were faced upward, and paper feeding was performed by an automatic paper feeder equipped internally with a heat-sensitive printer. As a result, all of the 100 sheets could be taken out one-by-one, and there was also no other trouble whatsoever in conveying.

When 100 sheets of the dye receiving sheet for preparation of the transmissive original with the same dimension were superposed on one another under a load of 2.5 kg and left to stand in a thermostat tank at 60° C., no blocking phenomenon was found, and also there was no problem in formation of image after standing. Thus it was confirmed that there was no problem in stability during storage.

EXAMPLE D-2

Example D-1 was repeated except that the following composition was used as the composition for formation of the lubricating layer.

| | |
|---|---|
| Acrylic resin (BR-85, produced by Mitsubishi Rayon K.K., Japan) | 15 parts by wt. |
| Polyethylene wax (MF8F, produced by Dura) | 0.5 part by wt. |
| Methyl ethyl ketone | 74.5 parts by wt. |

The dye receiving sheet for preparation of the transmissive original exhibited the same performances as that obtained in Example D-1.

EXAMPLE D-3

Example D-1 was repeated except that the following composition was used as the composition for formation of the lubricating layer, and further a 0.25% isopropanol solution of an antistatic agent (Statiside, produced by Analytical Chemical Laboratory of Scokey) was coated on the surface of the lubricating layer to a coated amount during coating of 10 g/m$^2$, followed by drying, to form a dye receiving sheet for preparation of the transmissive original.

Composition for forming lubricating layer:

| | |
|---|---|
| Acrylic resin (BR-85, produced by Mitsubishi Rayon K.K., Japan) | 15 parts by wt. |
| Methyl ethyl ketone | 75 parts by wt. |

The dye receiving sheet for preparation of the transmissive original, due to application of the antistatic agent on the surface of lubricating layer, was free from adhesion between sheets even when a lubricating layer containing no friction reducer was provided, without any trouble in paper feeding by way of automatic paper feeding. Also, since the lubricating layer was provided on the back surface, in spite of the amount of the antistatic agent being as small as 0.025/m$^2$ (calculated value) on the lubricating layer, a satisfactory adhesion prevention effect could be obtained without occurrence of a blocking phenomenon.

EXAMPLE D-4

On the surface of the transparent receiving layer in Example D-1, 0.25% isopropanol solution of the same antistatic agent as in Example D-3 was coated to a coated amount during coating of 6 g/m$^2$ by gravure coating, followed by drying, to form a transparent receiving layer applied with the antistatic treatment.

On the other hand, on the opposite surface to the lubricating layer of the same support sheet as in Example D-1, the same weak tackifier layer as in Example D-1 was provided, and stuck to the non-receiving layer surface of the film of the above film having the transparent receiving layer formed thereon, to obtain a dye receiving sheet for preparation of the transmissive original.

EXAMPLE D-5

The non-receiving surface of the film having a transparent receiving layer subjected to antistatic treatment formed thereon in Example D-4 and the surface of the weak tackifier layer of the support sheet provided with the lubricating layer subjected to the antistatic treatment in Example D-3 were contacted and stuck to each other to produce a dye receiving sheet for preparation of the transmissive original.

Under an environment of a relative humidity of 20%, automatic paper feeding was conducted by a heat-sensitive printer. As a result, the dye receiving sheet of Example D-5 was free from any trouble in conveying, and double delivery occurred three times in 100 times for the heat transferable sheet of Example D-4.

EXAMPLE E-1

By the use of a polyethylene terephthalate film with a thickness of 75 μm (T-PET, produced by Toyo Rayon) as the substrate, a composition for formation of a receiving layer having the composition shown below was coated on its surface by wire bar coating to a thickness on drying of 4 μm, dried tentatively by a dryer and dried in an oven of 100° C. for 30 minutes to form a transparent receiving layer.

Composition for forming receiving layer:

| | |
|---|---|
| Polyester resin (Vylon 200, produced by Toyobo, Japan) | 15 parts by wt. |
| Toluene | 30 parts by wt. |
| Methyl ethyl ketone | 30 parts by wt. |
| Amino-modified silicone (KF-393, produced by Shinetsu Kagaku Kogyo, Japan) | 5 parts by wt. |

Subsequently, after an urethane type primer layer was provided on a porous polyethylene terephthalate film having a density of about 80% relative to the density of non-foamed polyethylene terephthalate film (thickness 75 μm, density 1.16, commercially available as [porous PET], produced by Teijin K.K., Japan), a weak tackifier (acrylic emulsion, Esdaine AE-206, produced by Sekisui Kagaku Kogyo K.K., Japan) by a Myer bar and dried to provide a weak tackifier layer with a dry weight of 3 g/m$^2$, followed by pressure contact onto the receiving layer non-forming side of the substrate having the above receiving layer formed thereon to provide a dye receiving sheet.

On the receiving layer of the heat transferable sheet was superposed a sublimating transfer film having a sublimatable dye of cyan (molecular weight of 250 or more) carried with a binder resin, and thermal energy was imparted by a thermal head connected to electrical signals of the cyan component obtained by color resolution of a face photograph to obtain a cyan image. Next, with a sublimating transfer film using a sublimatable dye of magenta (molecular weight of 250 or more) and a sublimating transfer film using a sublimatable dye of yellow (molecular weight of 250 or more), sublimating transfer was performed successively in the same manner to form a display image comprising the face photograph of full color and other letters and figures.

The color image formed by transfer as described above was found to be without color drift, and also the image density was amply good.

The support was then peeled off from the above heat transferable sheet, and projection by means of an overhead projector gave a sharp projected image.

COMPARATIVE EXAMPLE E-1

A dye receiving sheet was obtained as in Example E-1 except for using a support of a non-foamed white polyethylene terephthalate film (thickness 75 μm, density 1.46, White PET E-20, produced by Toray, Japan). When a color image was transferred onto the dye receiving sheet, color drift of three colors was observed, with image density also being deficient.

EXAMPLE E-2

By the use of a polyethylene terephthalate film (thickness 9 μm), a mold release treatment was applied by a coating of an amino-modified silicone (KF-393, produced by Shinetsu Kagaku Kogyo, Japan) at a ratio of 1 g/m$^2$.

Next, on the surface on which the mold release treatment had been applied, a composition for formation of a receiving layer having the composition shown below was coated to a dry weight of 6 g/m$^2$ and dried to form a receiving layer.

Composition for forming receiving layer:

| | |
|---|---|
| Polyester resin (Vylon 200, produced by Toyobo, Japan) | 70 parts by wt. |
| Vinyl chloride-vinyl acetate copolymer (Vinylite VYHH, produced by Union Carbide) | 30 parts by wt. |
| Amino-modified silicone (KF-393, produced by Shinetsu Kagaku Kogyo, Japan) | 5 parts by wt. |
| Epoxy-modified silicone (X-22-343, produced by Shinetsu Kagaku Kogyo, Japan) | 5 parts by wt. |
| Solvent (methyl ethyl ketone/toluene = 1/1) | 700 parts by wt. |

On the other hand, the same porous polyethylene terephthalate film as that used in Example E-1 was coated with a urethane type adhesive, dried and then pressure laminated on the receiving layer non-forming surface of the above substrate having the receiving layer provided thereon to obtain a heat transferable sheet.

When color image transfer was effected on the dye receiving sheet as in Example E-1, a transferred image without color drift of three colors and ample image density was obtained. Next, after heat pressurization of this sheet onto the same card substrate as in Example E-1, the support was peeled off. As a result, the surface of the card was found to be smooth as a whole without occurrence of unevenness caused by the heat during transfer, and there was also no rising whatsoever at the image portion. Further, the image on this card was free from disturbance of image or interlayer peeling whatsoever even in the promotion test maintained in an atmosphere of 40° C. for 3 months. Also, when the light resistance test of JIS with a carbon black lamp was applied, the results were found to be 4 to 5 grade of JIS, thus exhibiting good performance. Also, against scratching of the surface, etc., good resistance was exhibited.

EXAMPLE E-3

With the use of a foamed polypropylene film having a density of about 69% relative to the density of non-foamed film (thickness 100 μm, density 0.62, Torephan BOYP, produced by Toray, Japan), a urethane primer layer was provided on its surface, and then the same weak tackifier layer as in Example E-1 (dry weight 4 g/m$^2$) was provided thereon, followed by pressure lamination by superposing on the receiving layer non-forming surface of the substrate having the receiving layer formed thereon in the same manner as in Example E-1 to obtain a dye receiving sheet.

When a color image was transferred onto the dye receiving sheet in the same manner as in Example E-1, a transferred image without color drift of three colors and ample image density was obtained. With the support peeled off from the sheet, projection was conducted by means of an OHP projector to produce a sharp projected image.

EXAMPLE F-1

On a polyester film with a thickness of 75 μm, an ink composition for formation of a transparent resin layer having the composition shown below was coated to a coated amount on drying of 10 g/m$^2$.

Ink composition for forming transparent resin layer:

| | |
|---|---|
| Polyurethane resin (Takelac A-712B, produced by Takeda Yakuhin, Japan) | 30 parts by wt. |
| Isocyanate curing agent (Takenate A-72B, produced by Takeda Yakuhin, Japan) | 18 parts by wt. |
| Ethyl acetate | 52 parts by wt. |

After the surface coated with the above ink composition was dried, a 12 μm polyester film was dry laminated on this surface to form a transparent substrate.

Next, on the 12 μm thick polyester film surface of the transparent substrate, the same ink composition for formation of a receiving layer as in Example A-1 was applied to a coated amount on drying of 3 g/m$^2$ to form a transparent receiving layer.

Next, the weak tackifier layer of the same support sheet provided with the weak tackifier as in Example A-1 and the non receiving surface of the above transparent substrate were stuck together to give a dye receiving sheet for preparation of a transparent manuscript.

By the use of the heat transfer sheet coated in the same three colors as in Example E-1, heating was effected by a thermal head under the same conditions to obtain a color image comprising a face photograph of full color and other letters and figures, which was also good in image density without color drift of the three colors.

The support sheet was peeled off at the weak tackifier layer surface, and projection was effected by an overhead projector to give a sharp and dense projected image.

Industrial Applicability

The dye receiving sheet according to the present invention can be visualized by using projection devices such as an OHP (overhead projector) or various slides and therefore can be used widely for preparation of transmissive originals. Furthermore, the dye receiving sheet for preparation of a transmissive original according to the present invention has excellent effects in running performance and operability within a heat-sensitive recording device, improvement of image density and sensitivity in carrying out printing, and therefore it is very useful in the field of transmission type image formation by the heat-sensitive transfer method.

We claim:

1. A dye receiving sheet for preparation of a transparency, said sheet being used in combination with a heat transfer sheet having a dye layer formed thereon, said dye receiving sheet comprising:

a transparent substrate having opposed surfaces;

a transparent receiving layer provided on a first opposed surface of said transparent substrate for receiving dye migrating from said heat transfer sheet corresponding to energy applied thereto from a thermal head;

an optically detectable support layer formed on an entire second opposed surface of said transparent substrate; and a tackifier layer interposed between said optically detectable support layer and said transparent substrate, such that said optically detectable support layer is freely peelable from said transparent substrate.

2. The dye receiving sheet of claim 4, wherein said optically detectable support layer comprises a light reflective layer.

3. The dye receiving sheet of claim 1, wherein said optically detectable support layer comprises a light shielding layer.

4. The dye receiving sheet of claim 2, wherein said optically detectable support layer comprises a sheet.

5. The dye receiving sheet of claim 1, wherein either said transparent substrate and said transparent receiving layer, or said optically detectable support layer, are cut to facilitate separation of said optically detectable support layer from said transparent substrate.

6. The dye receiving sheet of claim 1, wherein a physically detectable mark is further formed on said optically detectable support layer.

7. The dye receiving sheet of claim 1, wherein a transparent intermediate layer is provided between said transparent substrate and said transparent receiving layer.

8. The dye receiving sheet of claim 1, wherein an antistatic treatment has been applied thereto.

9. The dye receiving sheet of claim 1, wherein a lubricating layer is further formed on an outermost surface layer of said optically detectable support layer.

* * * * *